United States Patent [19]

Rycroft

[11] 3,983,645

[45] Oct. 5, 1976

[54] TAMPER-PROOF LABEL

[75] Inventor: Alan Rycroft, Rutherford, N.J.

[73] Assignee: Becton, Dickinson and Company, East Rutherford, N.J.

[22] Filed: Jan. 8, 1975

[21] Appl. No.: 539,347

[52] U.S. Cl. ..... 40/2.2; 292/307 A; 215/232; 215/256; 206/460

[51] Int. Cl.[2] ..... G09F 3/02

[58] Field of Search ..... 292/307 A; 40/2.2, 2 R, 40/2 B, 136, 27; 156/252; 206/460; 215/232, 256

[56] References Cited

UNITED STATES PATENTS

| | | | |
|---|---|---|---|
| 2,013,299 | 9/1935 | Byrne | 40/2 R |
| 3,221,427 | 12/1965 | Kaplan | 40/2 R |
| 3,230,649 | 1/1966 | Karn | 40/2 R |

*Primary Examiner*—Louis G. Mancene
*Assistant Examiner*—Wenceslao J. Contreras
*Attorney, Agent, or Firm*—Kane, Dalsimer, Kane, Sullivan and Kurucz

[57] ABSTRACT

A tamper-proof label adapted to be applied to joined surfaces of a member and heat sealed in place. A label includes a sheet adapted to bear identifying indicia with the sheet being cut in at least one location and the cuts being spaced so that they are located on each side of adjoining surfaces of the member to which the label is applied. The cuts permit material of the member to flow therethrough and over the exposed surface of the label when a predetermined amount of heat and pressure is applied so as to mechanically lock the label in position.

1 Claim, 3 Drawing Figures

TAMPER-PROOF LABEL

BACKGROUND OF THE INVENTION

Sealing and labeling of containers is a highly developed art. There are many instances where the sealing and labeling procedure is designed to prevent tampering of the container prior to the time of use. In the medical supply field as well as in the food packaging field it is often quite important that the integrity of the containers be maintained until the proper time. Of prime concern is the danger of damage and contamination of deterioration of the contents. By combining a labeling function with a tamper indicating function, two important aspects of packaging can be attained.

Two examples of the variety of different types of tamper-proof labels which are presently in use are depicted in U.S. Pat. No. 3,088,830 to Graham and U.S. Pat. No. 3,702,511 to Miller. From these patents it is quite apparent that tamper-proof labels are highly desirable. Accordingly, it is naturally advantageous to provide improvements in labels where the positive locking action of the label is assured and where it is virtually impossible to remove the label without damaging the container. Furthermore, the label should permit opening of the package and breaking of the label at the desired time in a quick, neat and efficient manner.

SUMMARY OF THE INVENTION

With the above background in mind, it is among the primary objectives of the present invention to provide a tamper-proof label for a container such as a plastic tube of separable components where the label can be heat sealed in place so as to be mechanically interlocked with the material of the container. The label is designed so that it cannot be removed without damaging the the container itself and when the container is opened the label will cleanly and neatly separate thereby controlling the area of rupture and providing a neat and sanitary appearance to the opened container. By being mechanically interlocked with the container, positive evidence of tampering is assured as well as maintenance of sterility status. The structure is more inexpensive and efficient to apply and utilize since it need only be applied to a portion of the circumference of a tubular member in use. Naturally, the mechanical interlock provides increased strength at the joint. The label is particularly useful in application on thermoplastic containers where the heat and pressure applied during the heat seal can cause the plastic to flow and engage in a mechanical interlock with the exposed surface of the label.

In summary, a tamper-proof label is provided which is adapted to be applied to joined surfaces of a member and heat sealed in place. A base sheet adapted to bear identifying indicia is provided with cuts in at least one location with the cuts being spaced so as to be located on each side of adjoining surfaces of a member to which the label is applied. The cuts permit material of the member of flow therethrough and over the exposed surface of the label when predetermined heat and pressure is applied after the label has been placed on a member thereby mechanically locking the label in position.

With the above objectives in mind, reference is had to the attached drawing.

DESCRIPTION OF THE PREFERRED EMBODIMENTS

Figure 1:
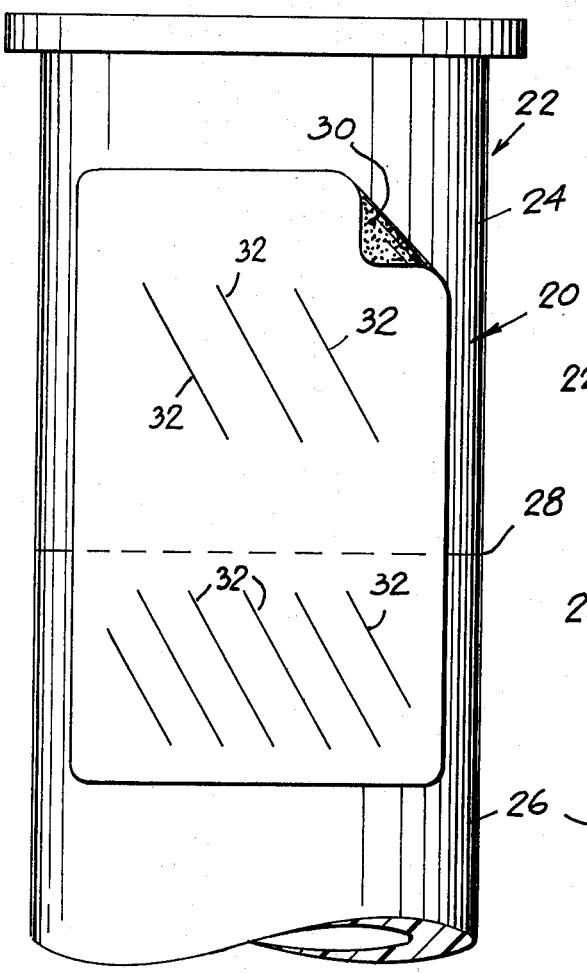
FIG. 1 is a fragmentary side elevation view of a container with a label of the invention being applied thereto.
Figure 2:
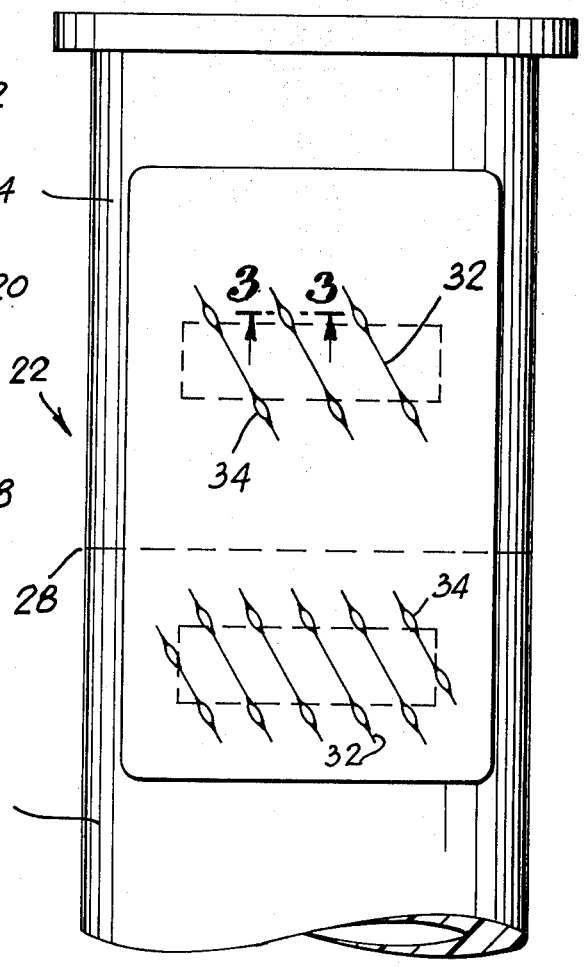
FIG. 2 is a fragmentary side elevation view of a container with a label of the invention mounted thereon.
Figure 3:
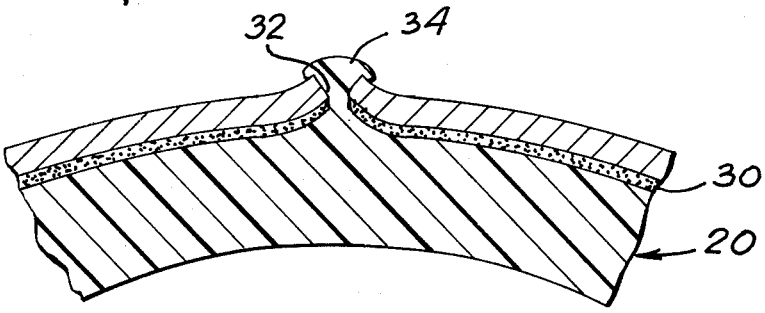
FIG. 3 is an enlarged fragmentary sectional view thereof taken along the plane of line 3—3 of FIG. 2.

Label 20 is a rectangularly shaped member which is designed for application to a structure to be sealed such as a syringe cartridge as depicted in FIGS. 1–3. The syringe cartridge 22 is of a typical design having an upper half 24 and a lower half 26. The halves meet at a common joining point 28 so as to seal an item such as a syringe inside of container 22. Common materials for container 22 include thermoplastic material such as polyethylene and polypropylene.

Label 20 is designed to accommodate indicia thereon for labeling of the container and to cover the joint line 28 of the two container halves to seal the container and prevent opening of the container without initial removal or breaking of the label. Any tampering with container 22 prior to the time of use would be evidenced by damage to label 20 which engages the separation line 28 for the container halves.

Label 20 is constructed of a material such as paper which is adapted to have indicia applied to one side thereof for identification of the container contents and to receive a well known conventional type of pressure sensitive adhesive backing 30 on the other side for initial engagement with the container when the label is applied. Label 20 is depicted as rectangular in configuration and naturally it may assume other configurations as long as it is of sufficient size to extend both above and below the joint line 28 and be applied to both container half 24 and container half 26. It is not necessary that the label 20 extend around the entire circumference of the container. It may cover only a portion of the container surface as depicted in the drawings.

Label 20 is provided with a plurality of cuts such as die cuts or prescores 32 on its surface with the cuts 32 being divided into two groups. One group is positioned on the label so that when the label is applied to a container they will be on one side of joint line 28 and the other group positioned so that they will be on the other side of joint line 28 thereby providing cuts 32 in alignment with each container half 24 and container half 26. While the cuts may take any reasonable configuration it has been found acceptable to use diagonal cuts as depicted.

In use, container 22 is filled with the desired object such as a medical instrument and the two halves 24 and 26 are brought into engagement to form joint line 28. Label 20 with cuts 32 therein and adhesive 30 on one side thereof is then applied to the container with the adhesive 30 engaging with the surface of container 22 so as to initially hold label 20 in position. Label 20 is positioned so that a portion including one group of cuts 32 is in engagement with container half 24 and the remaining portion of label 20 with a second group of cuts 32 is in engagement with container half 26. In this manner, label 20 extends on both sides of joint line 28 as well as covering a portion of joint line 28.

An appropriate heat sealing mechanism is then employed on the label so that heat and pressure applied by the heat sealing mechanism causes the material of container 20, which is a material such as thermoplastic, to soften and flow. Partial containment by label 20 forces the softened plastic to flow into the slits or cuts 32 in label 20 and flow over the surface of the label so as to form a mechanical lock with the fibers and surface of the label. This condition is best depicted in FIG. 3 of the drawing where material 34 has passed through slit 32 and has extended onto the upper surface of label 20 so as to mechanically retain label 20 in position against container 22. Label 20 is thereby sealed to the container 22 and cannot be removed without tearing and this provides evidence of tampering. Should an attempt be made to open the container, it can only be accomplished by damage to label 20 in view of the mechanical interlock between the container and the label. In fact, any relative movement of the plastic parts of any substance would also show as a rupture of the label 20. It should be kept in mind that it is desirable to have cuts 32 of larger size than the area of the tool which is utilized in making the heat seal. The heat seal can be applied in the prescored area by use of a conventional heat sealing tool for application of heat and pressure. The heat sealed bond also adds strength to the joint because the label itself creates a resistance to removal. In fact, where a label of this type has been applied to a 1cc. syringe in a conventional container, the result has been an additional resistance to rupture of approximately 2½ lbs. in tension for a paper label ⅜ in. wide. The paper employed for the label is of a conventional type and the pressure sensitive adhesive is also conventional well known product. It should also be kept in mind that the surface of the label to which the adhesive 30 is not applied should be of the type which is adapted to bear and display appropriate indicia.

In general, the label of the present invention provides positive evidence of tampering to thereby maintain sterility status for a common type of medical instrument such as a syringe being stored in a container. Furthermore, the label can be constructed of a conventional label stock with no additional structure other than the cuts being employed to utilize the label as a tamper-proof device. Furthermore, the present structure permits the label to be assembled to only a portion of the circumference of a structure such as a container thereby eliminating the necessity of a wrap-around design thereby reducing cost and simplifying application of the label. The strength of the joint is increased enhancing the possibility of bulk packaging of self-contained syringes without failure due to shield fall-off. The area of rupture when the container is opened is controlled resulting in a neat and sanitary appearance when the contents are to be utilized. Finally, heat sealing the label eliminates the necessity for special adhesives when plastic materials of unusual nature are employed. In this manner, the label is considerably more versatile in that a tailor-made adhesive is not required for each different type of plastic utilized for each different type of container.

Thus, the several aforenoted objects and advantages are most effectively attained. Although several somewhat preferred embodiments have been disclosed and described in detail herein, it should be understood that this invention is in no sense limited thereby and its scope is to be determined by that of the appended claims.

I claim:

1. A tamper-proof label affixed to joined surfaces of a thermoplastic member comprising; a sheet adapted to bear identifying indicia and being cut in predetermined locations with cuts located on each side of the adjoining surfaces of the thermoplastic member, the thermoplastic member having been subjected to heat and pressure so that the portions thereof adjacent the cuts have flowed therethrough and over the exposed surface of the label so as to retain and mechanically lock the label in position.

* * * * *